United States Patent [19]

Benson

[11] 3,980,280

[45] Sept. 14, 1976

[54] OSCILLATORY MIXER AND METHOD

[75] Inventor: Glendon M. Benson, Danville, Calif.

[73] Assignee: Energy Research & Generation, Inc., Oakland, Calif.

[22] Filed: Dec. 16, 1974

[21] Appl. No.: 533,380

Related U.S. Application Data

[62] Division of Ser. No. 259,885, June 5, 1972, abandoned.

[52] U.S. Cl. ..... 259/2; 259/8; 259/72; 259/DIG. 41

[51] Int. Cl.[2] ..... B01F 5/00; B01F 11/00

[58] Field of Search ..... 259/2, 72, 7–10, 259/14–17, 30–35, 57–59, 81–94, DIG. 41–DIG. 44

[56] References Cited

UNITED STATES PATENTS

| | | | |
|---|---|---|---|
| 3,063,813 | 11/1962 | Weinbrenner | 259/99 |
| 3,233,872 | 2/1966 | Bouyoucos | 259/4 R |
| 3,507,626 | 4/1970 | Horn | 259/2 |
| 3,623,703 | 11/1971 | Nielander | 259/47 X |
| 3,695,575 | 10/1972 | Hauser | 425/207 X |
| 3,708,256 | 1/1973 | Kopp | 425/376 |
| 3,712,783 | 1/1973 | Maxwell | 425/381.2 |
| 3,751,012 | 8/1973 | Michenko | 259/DIG. 41 X |

*Primary Examiner*—Stanley N. Gilreath
*Assistant Examiner*—Alan I. Cantor
*Attorney, Agent, or Firm*—Townsend and Townsend

[57] ABSTRACT

A material processing device and method for milling, emulsifying, dispersing, blending, polymerizing and hydrogenizing flowable materials. The device includes a processing chamber through which flowable material flows, an oscillating surfacing of the processing chamber which produces an oscillatory squeezing action on the flowable material within the chamber, an oscillating motor which drives the oscillating surface, a chamber inlet for dispersing the flowable material into the chamber and a chamber outlet for discharging and displacing the flowable material from the chamber.

9 Claims, 8 Drawing Figures

OSCILLATORY MIXER AND METHOD

This is a division, of application Ser. No. 259,885, filed June 5, 1972, and now abandoned.

This invention is directed to apparatus for milling, emulsifying, dispersing, blending, polymerizing and hydrogenizing flowable materials consisting of one or more components or mixtures.

When milling or blending flowable materials it is desirable to subject a small volume of flowable material to a very intense agitation so as to minimize the time that the material is subjected to such agitation. This is particularly true for explosives, propellants, thermosetting plastics and many pharmaceuticals. Further, it is often desirable to maintain these flowable materials at a prescribed temperature during blending. In addition, it is desirable to sequentially subject these flowable materials to several successive agitations, with each producing a finer milling, to achieve a high dispersion and a complete blending of materials while confined to a single small volume processing chamber.

Present blending systems rely upon low power intensities, large chamber volumes, small throughputs per unit chamber volume and single mode blending per chamber, and as a result cannot obtain fine dispersions with complete blending and therefore are incapable of achieving the above desirable features.

The present invention accomplishes the above features by introducing the flowable materials in a finely divided state (achieved, for example, by injection through peripherially located small orifices or slits) into a disc-shaped processing chamber and then immediately dispersing these materials by an oscillatory squeezing action produced by an oscillating chamber surface to further disperse and blend the materials. As the flowable materials flow radially inward in the processing chamber they are more finely dispersed by a microscopic shearing action caused by the high frequency oscillation of the oscillating chamber surface and finally are subjected to cavitational and vibrational actions produced by the oscillating chamber surface prior to exiting from the processing chamber through a centrally located port of the chamber. As a result, the flowable materials are first dispersed by narrow flow channels that cause shearing and initial breakup of the materials into a dispersed state which can then be effectively acted upon three successive actions that occur in the same processing chamber to produce an increasing degree of dispersion, viz. macroscopic high shear, microscopic high shear and cavitation. Eliminating the first dispersion step by using large flow area channels prevents the other processing actions from being effective and results in either an extremely slow throughput or an unsatisfactory blend. Using just the first dispersion step but eliminating the subsequent processing actions allows the components to reagglomerate prior to leaving the processing chamber and results in a crude dispersion with unsatisfactory blend.

This invention will be more fully understood when reference is made to the following detailed disclosure, especially in view of the attached drawings wherein.

Figure 1:
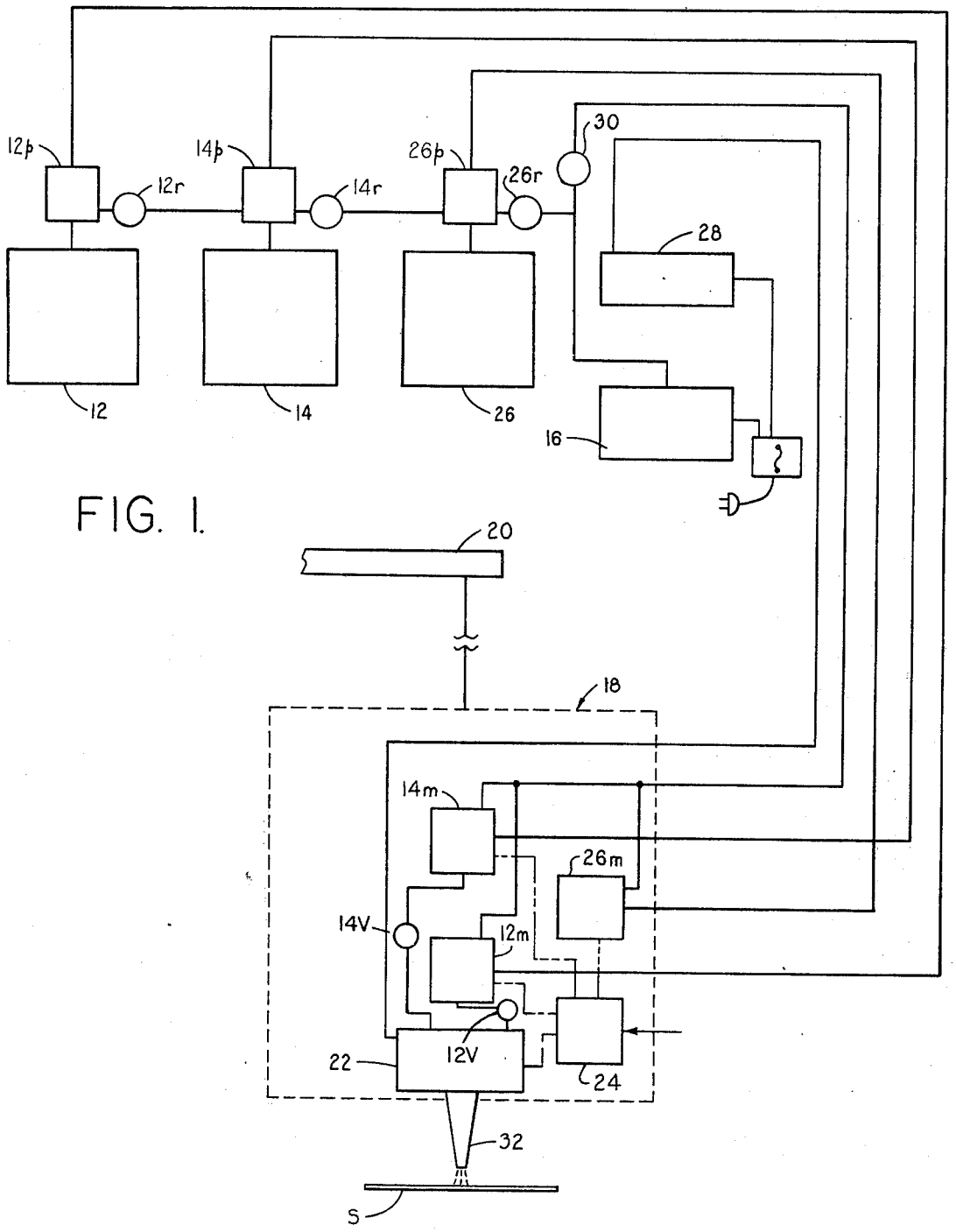
FIG. 1 is a block diagram of a system in which the present invention can be employed with advantage.

Referring now to the drawings, wherein similar characters of reference represent corresponding parts in each of the several views, there is shown in FIG. 1 two drums 12 and 14 containing flowable constituents that are to be processed and intermixed when passed through the processing device. On each drum is mounted a transfer pump 12*p* and 14*p*, respectively, that are air driven by an electrically driven compressor 16, which pressurizes the constituents in drums 12 and 14 to separately prescribed pressures regulated by air pressure regulators 12*r* and 14*r*, respectively, so as to transfer the constituents at their respective constant feed pressures to a delivery head assembly 18 that is suspended from a boom 20. The delivery head includes metering devices 12*m* and 14*m* for establishing preselected rates of delivery of the respective constituents from drums 12 and 14. The outputs of metering devices 12*m* and 14*m* are fed to a processing device 22 carried in delivery head assembly 18. Delivery head 18 also includes a trigger apparatus 24 which controls the elements as described hereinbelow.

The system of FIG. 1 also includes a solvent drum 26, a transfer pump 26*p*, and an air pressure regulator 26*r* which cooperate to deliver solvent to a metering device 26*m* in delivery head 18 when it is desired to clean the parts of the head. Finally there is a power pack 28 for supplying power to the elements in the delivery head and air pressure regulator 30 for regulating air pressure which controls the plunger valves and metering pumps.

The sequencing action of the boom-suspended-assembly is as follows. The closing of trigger 24, either by manual or electronic means, energizes the drive actuator on plunger valves 12*v* and 14*v* and drives the plunger downward to open the valve ports between metering pump 12*m* and 14*m* and the chamber in processing device 22. Simultaneously, the drive actuator on the metering pumps is energized and drives the metering pumps downward to displace, at a fixed volume ratio, the two constituents through their respective plunger valves 12*v* and 14*v* and passageways into the chamber of the processing device 22. Simultaneously, processing device 22 is energized by power pack 28 and processing action starts with full power output obtained in a few milliseconds. The constituents are injected into the chamber under a specified feed pressure controlled by air pressure regulator 30 which controls the air pressure to the air driven actuators of the plunger valves and the metering pumps. The injection feed pressure forces the constituents through the processing chamber, where they are processed, and then as a processed stream through the outlet port at the bottom of the chamber where the processed stream is either collected by containers or tubing or is deposited through a nozzle 32 on a substrate S as shown. Opening trigger apparatus 24 reverses the plunger valve actuator which closes the metering pump-chamber ports and opens the transfer pump feed line ports to the metering pump ports, de-energizes the metering pump actuator, shuts off the power to the processor furnished by power pack 28, and drives the lower processing chamber plate in processor 22 upward so as to displace the remaining processed material from the processing chamber. The transfer pumps 12*p* and 14*p* transfer constituents through their respective plunger valves into their respective metering pumps refilling by positive displacement the metering pumps for the next cycle. This completes one cycle of the system and the boom-suspended assembly is passive until the next cycle is initiated by closure of trigger 24. Due to the use of fast response control systems and short fluid coupling lengths, the cycle time for the above described cycle is significantly less than one second and depends almost entirely on the duration of the dispensing cycle. The volume of processed material remaining in the processing chamber after completing the above cycle is appreciably less than one cubic centimeter and has the geometry of a thin disc having a thickness of approximately 0.001 in. This thin volume or section is cooled by the intimate contact of the upper and lower metal plates of the processing chamber which, if necessary, prevent the constituents from undergoing an exothermic reaction.

Flushing of the boom-suspended-assembly is achieved by the solvent metering device 26*m*, which in turn opens ports allowing solvent from solvent drum 26 to be pressure fed by solvent transfer pump 26*p*, controlled by pressure regulator 26*r* through all fluid passages of the boom-suspended-assembly and out through the processed-stream port through nozzle 32 at the bottom of the mixer.

Alternate systems to the self-contained modular system shown in FIG. 1 include double-acting metering pumps and plunger valves as well as rotary metering pumps for continuous rather than intermittent cyclic operation; the remote location of the plunder valves and metering pumps from the processing device; replacement of air driven actuators with hydraulic or electric actuators; and variations in type and arrangement of storage vessels for the unprocessed flowable materials and fluid transfer pump means, including pressurized storage containers.

Figure 2:
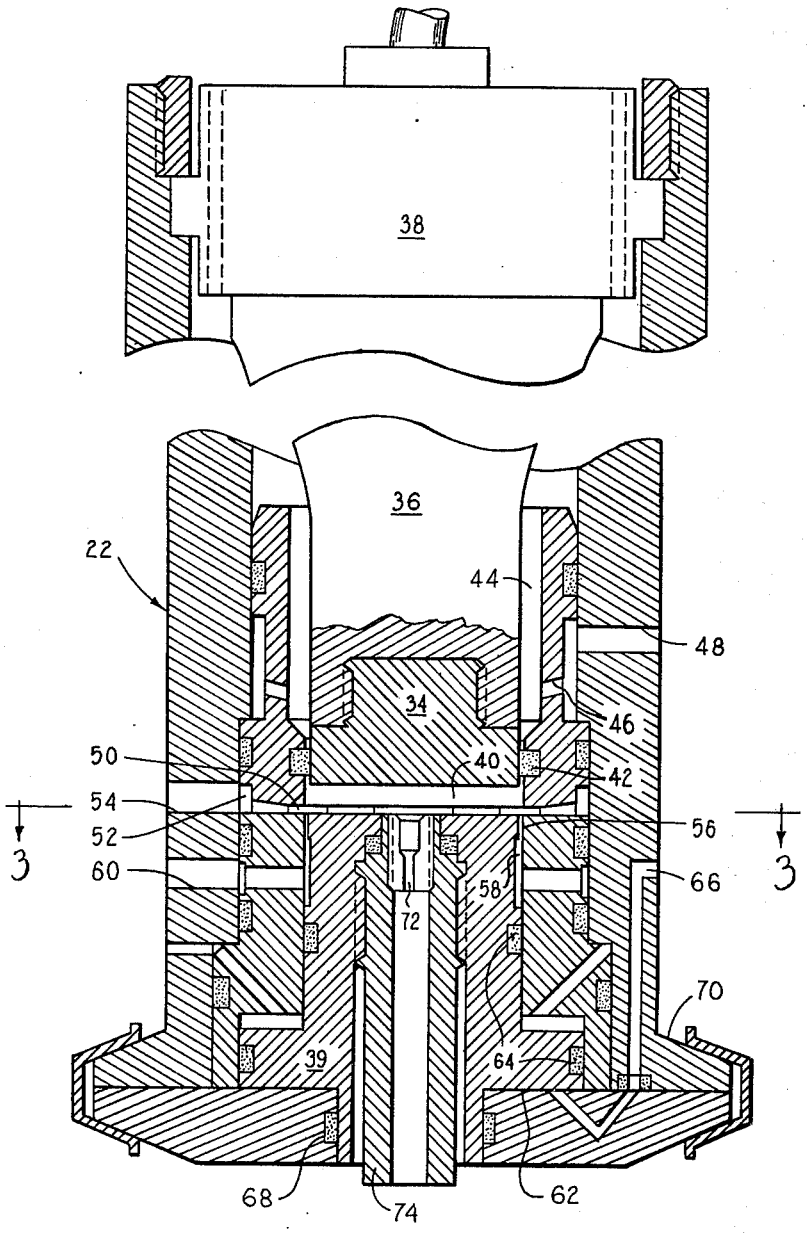
FIG. 2 is a cross-sectional view of one embodiment of the invention.

The processing device 22 for two flowable constituents is shown more clearly in FIG. 2 in which: the oscillating upper plate 34 is coated with an erosion resistant coating and forms the replacable tip of a cone-shaped rod 36, that functions as a mechanical impedance transformer whose opposite end is acted on by the oscillating motor 38 that oscillates plate 34 through rod 36; the movable lower plate 39 acts as a plunger to displace processed material from processing chamber 40 at the completion of a processing cycle; the static elastomeric chamber seal 42 seals the processing chamber from the upper cavity 44 which acts as the exhaust duct for coolant injected through nozzles 46 and supplied through an inlet connection 48; the injection nozzles 50 that inject one component to be processed into processing chamber 40 from upper annular feed channel 52 supplied through connection 54; the injection ring 56 that injects the other component to be processed into chamber 40 from lower annular feed channel 58 supplied through connection 60 and sealed from displacer chamber 62 by elastomeric seals 64; the displacer chamber 62 which displaces processed fluid from processing chamber 40 at the completion of a processing cycle and that is connected to pressurized fluid source by connection 66 and sealed by elastomeric seal 68; and the housing 70 which contains the entire processing device. In operation flowable constituent in drum 12 is pressurized and is fed through tubing, connected to connection 54, and then flows around upper annular channel 52 and is injected through nozzle 50 as a dispersed thin sheet or as disrupted jets into processing chamber 40. Nozzle 50 is formed between the peripheral margins of the surfaces of upper plate 34 and lower plate 39 that bound chamber 40. Similarly flowable constituent from drum 14 is pressurized and is fed through tubing, connected to connection 60, and then flows around lower annular channel 58 and is injected through injection ring 56 as a dispersed thin annular sheet into processing chamber 40 where it impinges on the constituent entering through nozzle 50 to form a coarsely dispersed mixture which in turn is immediately broken-up into a finer dispersed mixture by the oscillation of the oscillating upper plate 34, resulting in a macroscopic high shearing and blending action. As this dispersed mixture flows radially inward in processing chamber 40 it is subjected to a high shear action imparted by the oscillating upper plate 34 which alternately squeezes and expands the mixture subjecting it to violent radial oscillations with concommitant layer intermixing and scrubbing actions which disperse the mixture on a microscopic basis. The mixture continues to flow radially inward with a subsequent reduction in pressure due to viscous drag of the flowable material and is subjected to a high intensity cavitation action, produced by the rapidly oscillating upper plate 34, which produces a violent blending and dispersing action that causes mixture interactions to occur down into the molecular size range, which in turn promotes polymerization and branch chaining or rupturing of molecular bonds, depending on frequency and intensity of cavitation. The finely dispersed and thoroughly blended components then flow from the processing chamber 40 through an exit port 72 forming an air-less spray pattern or a single-ligament stream depending on exit port geometry, mixture properties and mixture pressure drop occurring across the exit port. Alternately, tubing can be attached to the exit fitting 74 which transports the processed components from the processing chamber. At the completion of one processing cycle fluid pressure is transmitted through tubing connected to connector 66 into displacer chamber 62 which drives lower plate 39 upward displacing processed components from processing chamber 40 out through exit port 72. Typical processor specifications are presented in the following table:

TYPICAL PROCESSOR SPECIFICATIONS

| | | |
|---|---|---|
| Processing Chamber 40 | | 0.25 – 1.00 |
| Diameter (in.): | | 0.020 – 0.140 |
| Height (in.): (20kHz) | | |
| Processing Power (kw): | | 0.5 – 4.0 |
| Processing Frequency (kHz): | | 5 –40 |
| Chamber Pressure (psi): | | 50 – 400 |
| Feed Rates (cc/sec): | | 0.5 – 60 |
| Orifice Sizes | | |
| Nozzles (in.): | 50 | .005 – .040 |
| Annular Slots (in.): | 56 | .0005 – .005 |
| Exit Orifice (in.): | 72 | .010 – .100 |

The temperature of the processing chamber can be controlled by providing recesses in housing 70 which accommodate either heating elements, such as electric resistance cartridge heaters, or cooling elements, such as thermoelectric cartridge coolers, or by providing internal passageways through which a heated or chilled fluid is circulated or in which a pressurized fluid is expanded to provide cooling. The control of temperature can be provided by thermistors or temperature sensors embedded in housing 70 or exposed to exit stream at exit port 72.

Processing action is tailored to the particular flowable constituents by adjusting oscillating frequency and stroke of oscillating upper plate 34, by varying feed pressure of components which varies mass-rate throughput and intensity of cavitation, by varying size of injection orifices 50 and 56 which varies initial breakup and dispersion, and by varying exit port 72 which controls pressure in mixing chamber for a constant feed pressure. Owing to this control over processing action and the sequential blending and dispersing action that occurs within the processing chamber a wide range of flowable constituents can be blended, emulsified, milled, polymerized and dispersed, including magnetic oxide and other two-phase solid-liquid slurries, as well as liquid-plastic foam and other gaseous-liquid two-phase mixtures. In addition, changes in physical and chemical properties of processed constituents can be obtained when processed by this invention, relative to conventional processing methods. Reactive constituents experience a rapid exotherm due to induced excitation. As a result, increased physical and chemical properties are achieved e.g. doubled tensile and yield strengths, increased ductility or resiliency and modulus values and increased stability or inertness. Cure rates are increased at least an order of magnitude e.g. cure times for one high strength polymer were reduced from 50 sec. to 1 sec. under ambient cure conditions. Effectiveness of fillers is increased due to the intimate dispersion and wetting produced, e.g. constant thixotrophy characteristics have been obtained by reducing filler concentration by a factor of 10, or more with a concommitant increase in physical and chemical properties. Emulsion stability is increased, or stability is insured with reductions in or elimination of stabilizers. Exotherms can be precisely controlled to insure uniformity of foam products. Effectiveness of sealants and adhesives is increased which reduces the quantity of material required. This combined with the significant increases in cure-rate make feasible production-line schedules using inexpensive components without the use of cure-ovens or costly additives. Microratio additives can be fully and uniformly dispersed in single-pass throughputs, even for highly dispersion-resistant pigments, catalyst, pharmaceuticals and biological materials. In addition because of the thorough blending and dispersing of constituents in processing chamber 40 additional solid, liquid or gaseous additives can be added through additional injection ports to enhance chemical reactions (by adding catalysts), hydrogenation (by adding gaseous hydrogen), pigmentation (by adding pigments) gasification (by adding gas or gasifiers to produce stable foams and emulsions) as well as adding surfactants, rheology modifying additives, emulsifiers, homogenizers and polymerizes as well as unstable liquid and solid reactants for propellants and explosives.

The oscillating upper plate 34 of FIG. 2 is driven by an oscillating motor 38 mounted at the opposite end of the cone shaped mechanical impedance transformer 36. The oscillating motor may be electrically, mechanically, hydraulically or pneumatically driven. Examples of electrically driven oscillating motors include those driven by magnetostrictive, piezoelectric, electroexpansive, electromagnetic or electrostatic devices. Examples of mechanically driven oscillating motors are those that employ an unbalanced shaft that is rotated at a high speed by air driven turbines or electric motors. The hydraulically and pneumatically driven oscillating motors employ an oscillating mass that is driven by either hydraulic or pneumatic pressure such as described in U.S. Pat. Nos. 2,792,804 and 3,004,512 and in Bouyoucos, J. V. "Hydroacoustic Transduction — A Survey", U.S. *Navy Journal of Underwater Acoustics*, Vol. 11, No. 3 July 1961; and Lesser, M. W., "Sea Pressure Head Energy Storage and Hydroacoustic Conversion", *Proc. IECEC*, p. 254 (1966). Of these oscillating motors the two that have proven to be the most compact, efficient, reliable and versatile are the piezoelectric and the hydroacoustic type which provide power levels at the upper oscillating plate 34 which range from approximately 10 watts to 20 kw for present piezoelectric devices and up to 1000 kw attainable in present hydroacoustic devices. These powers are directly available for processing flowable materials in the processing chamber at oscillating frequencies ranging from approximately 100 Hz to 100 Khz and result in power densities of up to approximately 1 kw/cm$^2$ (10 hp/in.$^2$) of processing chamber surface area, which in FIG. 2 refers to the cross-sectional area of upper oscillating plate 34. Power densities are limited to this value due to material strengths of the upper oscillating plate and the spall and wear resistance of this plate's surface, with higher powers causing plate fracture and surface spalling, unless excessive mixing chamber pressure are employed on fluids having large bulk modulus values.

The geometry and configuration of the mechanical impedance transformer 36 that connects the oscillating motor 38 to the upper oscillating plate 34 is determined by the stroke and oscillating frequency of this plate which oscillates either at or in multiples of the frequency produced by the oscillating motor, with such geometry and configuration relations for this transformer well known to those skilled in the art and summarized in Martiner, J. G. and Hanagud, S. V. "Design of High Amplitude Resonators", JASA, 44, 3,717 (1968); and Crawford, A. E., "The Design of Work Horns for High Power", Ohio State Univ., Columbus, Ohio (1968). By varying the geometry and configuration of this transformer and the oscillating plate 34 different surface motions and various focusing profiles of oscillating energy can be obtained and applied to the flowable material in the processing chamber.

Figure 3:
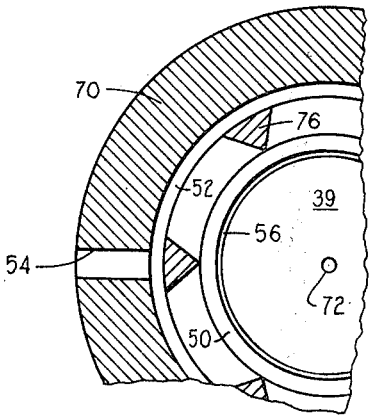
FIG. 3 is a fragmentary cross-sectional view taken along line 3—3 of FIG. 2.

The processing chamber 40 of FIG. 2 operates by virtue of the effects produced by the oscillating upper plate 34 which produces an oscillating squeeze action on the flowable material, which in turn induces high shear rates between adjacent layers of the flowable material as well as cavitational effects and other vibration-responsive effects within the flowable material. As a result, the flowable material is processed within itself by the application of an external action, viz. body processing effects are induced by oscillatory surface effects. For these effects to occur the processing chamber requires enclosing surfaces, one or more of which oscillates, with the surfaces separated by a distance approximately equal to or less than the ratio of the chamber surface area to the propagational wavelength occurring within the flowable material, and a device which introduces flowable material into the chamber in such a manner that the largest agglomerates of material introduced have a size smaller than this separation distance. The embodiment shown in FIG. 3 introduces both constituents radially into chamber 40 and includes radially convering guides 76 to so introduce the constituents. This form of the invention is preferred in cases where the constituents are introduced in generally equal volume ratio quantities.

Figure 3A:
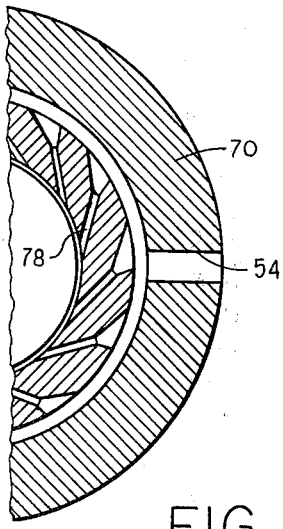
FIG. 3A is a view similar to FIG. 3 and showing an embodiment of the invention.

In cases where the constituents are introduced in markedly unequal volume ratios, tangential introduction of at least one of the constituents, e.g. the constituent from drum 14, is preferred. FIG. 3A is a cross-sectional view of a processing unit modified to afford tangential introduction. The device of FIG. 3A is identical to the device shown in FIGS. 2 and 3 except that nozzle 50 is replaced by a plurality of tangentially extending channels 78 the communicate one of the constituents from annular feed channel 52 to chamber 40.

The processing chamber, as shown in FIG. 2, can be modified in several ways while not departing from this invention and these modifications include the following.

The bottom movable plate 39 can be driven by a second cone-shaped mechanical impedance transformer attached to a second oscillating motor in which exit port 72 is gun-drilled axially through the second cone-shaped transformer rod to the nodal point of this rod and then radially drilled to the outside diameter of this rod where connection is made to external tubing that transfers the processed components from the processing unit. The lower movable plate can be driven at a frequency and stroke different from that of the upper movable plate. In addition, the lower movable plate can consist of two sectons, one as shown in FIG. 2 but with an enlarged center axial hole into which a second plate with cone-shaped transformer rod is elastomerically shear-sealed and driven by an oscillating motor mounted on the transformer rod end opposite to the inner lower movable plate of the processing chamber.

Another embodiment of this invention employs a modified upper oscillating plate 34 of FIG. 2 which comprises an inner plate driven by an inner cone-shaped transformer rod and an annular plate and tubular cone-shaped transformer rod concentric to the inner plate and inner transformer rod. The inner plate is spaced and sealed from the outer plate by an elastomeric shear seal which is cooled by a coolant flow passage that extends down through the annular space between the inner and outer rods and then through the radially drilled holes in the outer plate above the shear seal that communicates with the upper cavity 44 shown in FIG. 2. This configuration permits the inner plate to be separately driven at a different frequency and a different stroke than the outer plate. For example, the outer plate can be driven at 2 kHz and 0.050 in. stroke while the inner plate is driven at 20 kHz and 0.005 in. stroke.

Figure 4:
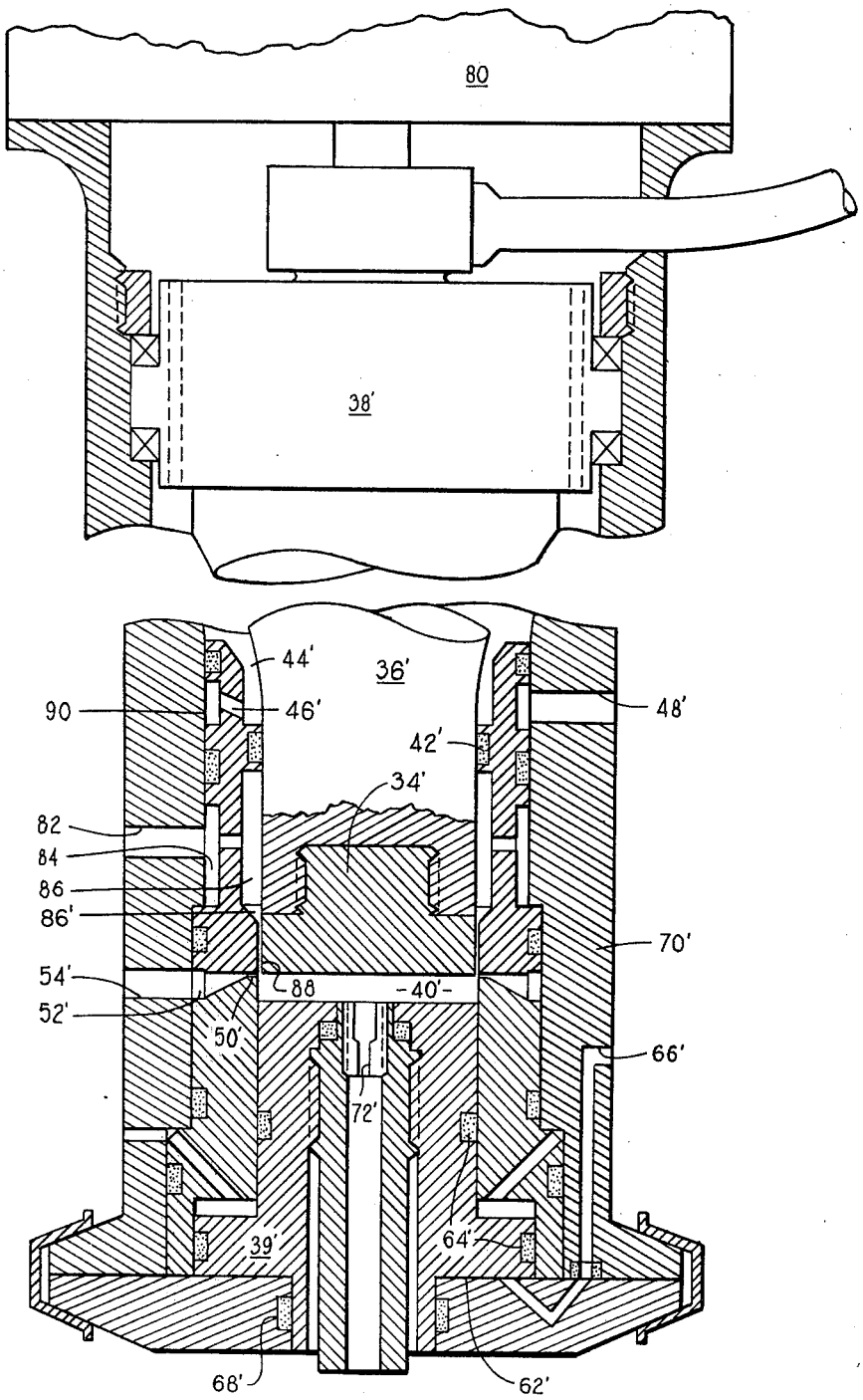
FIG. 4 is a cross-sectional view of another embodiment of the invention.

Another embodiment of this invention is shown in FIG. 4 in which parts identical to those in the embodiment of FIG. 2 are identified. The upper oscillating plate 34' is simultaneously reciprocated by the oscillating motor 38' and rotated by the rotary motor 80. The constituent from drum 12 under pressure enters inlet port 82, flows around annular chamber 84 and down through annulus 86' and finally through narrow annular orifice 88 where it enters processing chamber 40 in the form of a thin sheet. Comparing this flow path with the flow path for the component fed into connector 60 of FIG. 2, it may be noted that the flow channels and method of injecting the component into the processing chamber are similar. Likewise the component flow path through entrance port 54', annular chamber 52' and injection ports 50' is similar for FIGS. 2 and 1 as well as are lower movable plate 39' displacer chamber 62', seals 64' and 68', port 66' housing 70' and outlet orifice 72' but with greater length. In FIG. 4 seal 42' is located at the nodal point of mechanical impedance transformer 36' and provides a rotational seal between annular chamber 84 and chamber 44'. Coolant enters port 48', flows around an annular passage 90 and is injected through expansion nozzles 46' to cool seal 42' and then exhausts through chamber 44'. Processing action occurring in processing chamber 40' is similar to that produced by the oscillation of upper oscillating plate 34 of FIG. 2 but is augmented by the undirectional rotation of plate 34' by transformer rod 36'. This rotation provides an enhancement in fluid breakup and dispersion where the two component streams coalesce as well as provides some enhancement in macroscopic blending occurring near the periphery of plate 34' but has negligible enhancement on the cavitational processing action occurring near the axis of plate 34'. The design shown in FIG. 4 provides better dispersion and blending for highly viscous fluids, or provides higher throughputs and lower feed pressures for less viscous fluids than that design shown in FIG. 2. However, the response time is slower in the unit shown in FIG. 4 than that of FIG. 2, owing to the time required to accelerate transformer rod 36' and plate 34' to a steady-state rotational speed and therefore the mixer of FIG. 4 is more adaptable to continuous flow processing applications than to rapidly cycled intermittant flow processing applications. The processing chamber shown in FIG. 4 represents a versatile processor for laboratory applications since for some fluids, processing may be achieved solely by rotation of plate 34' while other fluids may be processed soley by oscillation of plate 34' while still other fluids may be processed by the combined rotation and oscillation of plate 34'.

Figure 5:
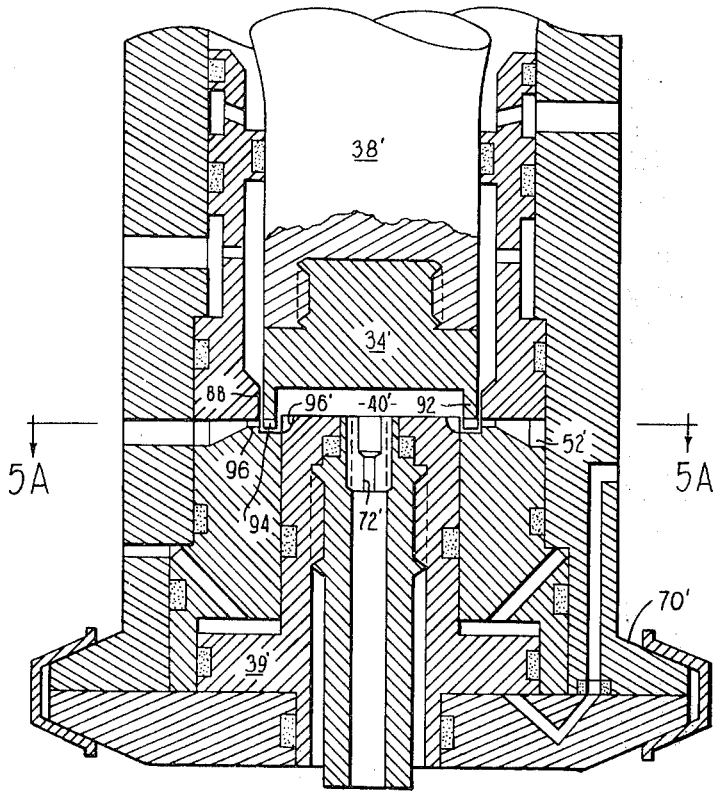
FIG. 5 is a cross-sectional view of still another embodiment of the invention.
Figure 5A:
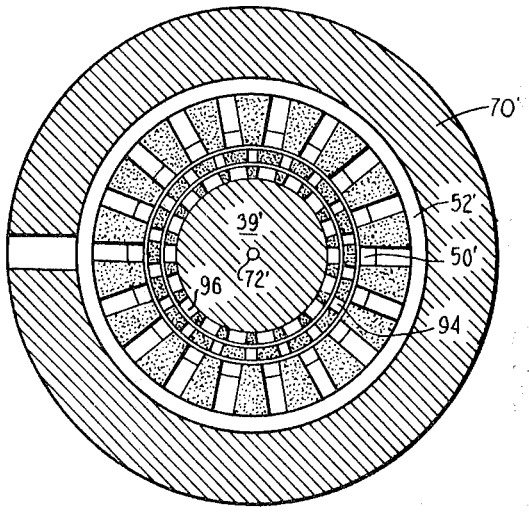
FIG. 5A is a cross-sectional view taken along lines 5A—5A of FIG. 5.

Another embodiment of this invention is shown in FIG. 5 which represents a modification of the injection means shown in FIG. 4 for producing an improved coarse dispersion prior to entrance to processing chamber 14. The difference in the two designs is that in the design shown in FIG. 5, the lower face of plate 34' is rimmed by a cylindric extension 92 at the periphery and contains teeth 94 which define one boundary of nozzle 50. The other boundary of the nozzle is formed with slots 96 that align with teeth 94, and lower end plate 39' has a profiled peripheral rim with slots 96' that align with teeth 94. In operation plate 34' rotates and oscillates with one flowable material component flowing through annular flow passage 88 and the other flowable material component flowing through nozzle slots 96. These two flowable material components impinge on the teeth 94 of plate 34', which acts as a rotor that breaks up and disperses large agglomerates of these two flowable material components prior to discharging the mixture into the profiled slots 96' of lower plate 39' which in turn removes any rotational direction imparted to the mixture prior to introducing the mixture into processing chamber 40' where the mixture undergoes the same processing action as occurs in the processing chamber for the design shown in FIG. 4. The advantage of the toothed processor shown in FIG. 5 is that it has the ability of breaking up and dispersing extremely viscous and fibrous feed material and can produce a finer dispersion of feed material relative to that produced by the design shown in FIG. 4. alternates to the design shown in FIG. 5 include vertical slots or a helix, instead of the horizontal slots, shown in FIG. 5, in which the feed material flows downward, through rotor teeth in the upper plate 34', into the processing chamber. Other alternates to the teeth are vanes or blades which rotate as the teeth 94 in FIG. 5.

The rotary motor 80 that drives plate 34' of FIG. 5 can be replaced with an oscillator that causes the mechanical impedance transformer rod 38' and upper plate 34' to oscillate in a rotational manner through an arc segment of two teeth widths. The oscillator motor permits rapid start up (on the order of a few milliseconds) and thereby enables this embodiment to operate on an intermittant basis.

Figure 6:
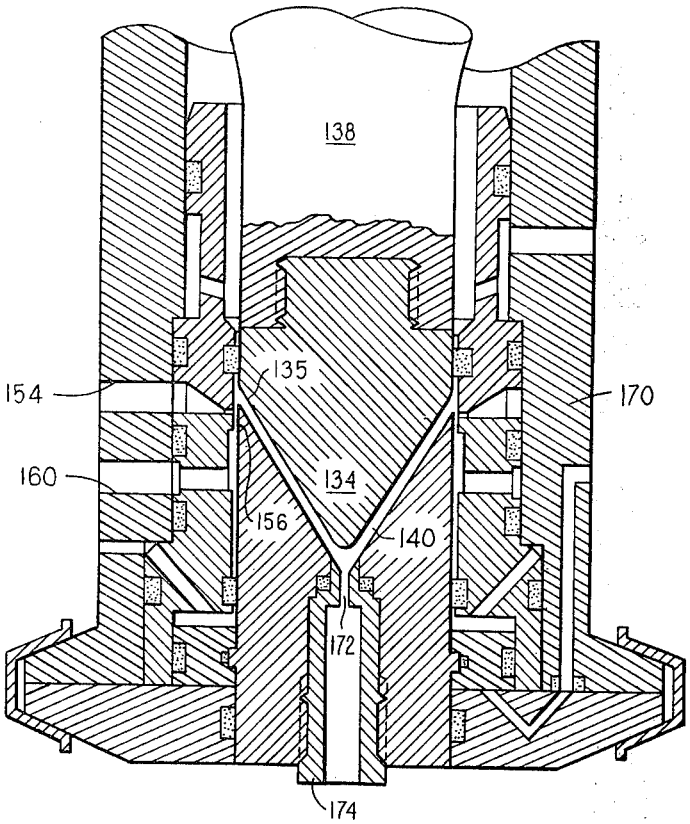
FIG. 6 is a cross-sectional view of yet another embodiment of the invention.

An alternate structure for dispersing the constituents prior to introduction to the processing chamber is shown in FIG. 6 in which a tubular oscillator is used. In FIG. 6 there are employed reference numerals greater by one hundred than reference number identifying corresponding parts in FIGS. 2, 3 and 4. An upper plate 134 of this oscillator oscillates radially at 135 and is driven by oscillating motor through an impedance transformer 138, producing a shearing action similar to that of rotor teeth 94 of FIG. 5 but of lower amplitude. The primary advantage of this tubular conical oscillator over the toothed rotor of FIG. 5 is that the tubular oscillator is more easily cleaned and less subject to fouling, whereas both designs have equally short startup times.

Other embodiments of the invention include a grooved or pocketed surface on upper plate 34 and a curved rather than a flat surface to enhance and focus the oscillating energy imparted to the material being processed.

Thus it will be seen that the present invention provides an efficient processing device that is capable of high throughputs and of processing materials that heretofore have been impossible to mill, blend, disperse, emulsify or homogenize. Moreover, as a result of the thorough processing and the short time the components are exposed to the processing action, improved characteristics of processed materials can be obtained over that obtained when processed by conventional methods.

It will be appreciated by those skilled in this art that the processing devices of this invention can be used for other purposes in addition to blending and dispersing flowable material components. For example, the devices of this invention may be employed to depolymerize, dissolve, extract, catalyze, precipitate, disrupt, deglomerate, sterilize, defoam and produce similar vibration-responsive chemical reactions and processes in flowable material components that are processed by this invention.

Although several embodiments of the invention have been shown and described, it will be obvious that other modifications and adaptations can be made without departing from the true spirit and scope of the invention.

What is claimed is:

1. A material processing device comprising means for introducing and dispersing flowable material into a disc-shaped processing chamber defined at least partially by two substantially fluid impervious end plates and a peripheral margin, means for rotating at least one of said end plates of said chamber, means for driving only one of said end plates in oscillatory motion to produce high shear rates within said material contained in said chamber, and means for removing and displacing processed said material from said chamber.

2. Apparatus as recited in claim 1 wherein said first and second members are spaced at a distance approximately equal to or less than the ratio of the surface area of the chamber to the propagational wavelength of the processed flowable material in said chamber.

3. Apparatus for intermixing at least two flowable constituents comprising first and second members having confronting spaced apart substantially fluid impervious surfaces bounded by a peripheral margin thereby to define a chamber, means for introducing said constituents at said peripheral margin so that the constituents flow radially inwardly into said chamber, means for driving said first member in oscillatory motion to impart to said constituents corresponding oscillatory agitation, means for rotating at least one of said members to impart to said constituents corresponding rotary shearing action, and a portion of said second member inward of the periphery thereof defining an outlet at the surface thereof for discharging said constituents from said chamber.

4. Apparatus as recited in claim 3 wherein said first and second members are spaced at a distance approximately equal to or less than the ratio of the surface area of the chamber to the propagational wavelength of the processed flowable material in said chamber.

5. Apparatus as recited in claim 3 wherein said introducing means includes narrow flow channels that produce course dispersions by fluid impingement and fluid circulation at all entrances to the chamber.

6. A method for the processing of flowable material comprising the steps of: providing a chamber having opposed spaced apart substantially fluid impervious walls bounded by a peripheral margin, continuously introducing flowable material at the peripheral margin of said chamber so that said material flows radially inwardly into the chamber; driving only one of the opposed walls in an oscillatory squeezing action which imparts to said material a corresponding oscillatory agitation; rotating at least one of the opposed walls which imparts to said material a rotary shearing action superimposed on said oscillatory agitation; providing an opening in one of the opposed walls inward of the periphery thereof; and continuously removing said processed material from said chamber through the opening.

7. A method as recited in claim 6 wherein said rotating step includes rotating said driven wall.

8. A method as recited in claim 7 wherein said rotating step includes rotating solely said driven wall.

9. A method as recited in claim 6 wherein said introducing step includes subjecting the flowable material to dynamic dispersion.

* * * * *